US006319177B1

(12) United States Patent
Levine

(10) Patent No.: US 6,319,177 B1
(45) Date of Patent: Nov. 20, 2001

(54) PORTABLE AND PIVOTAL STATIONARY EXERCISE SYSTEM

(76) Inventor: Dan Levine, 151 W. Brookline St., Apartment 3, Boston, MA (US) 02118

( * ) Notice: Subject to any disclaimer, the term of this patent is extended or adjusted under 35 U.S.C. 154(b) by 0 days.

(21) Appl. No.: 09/385,473

(22) Filed: Aug. 30, 1999

(51) Int. Cl.[7] ..... A63B 23/00

(52) U.S. Cl. ..... 482/100; 482/146; 482/147; 482/142

(58) Field of Search ..... 482/146, 147, 482/140, 130, 142, 95, 96

(56) References Cited

U.S. PATENT DOCUMENTS 1,283,210 * 10/1918 Kinney ..... 482/146
3,713,653 * 1/1973 Romans ..... 482/146
3,782,721 * 1/1974 Passera ..... 482/146
4,186,920 * 2/1980 Fiore et al. ..... 482/147
4,249,727 * 2/1981 Dehan .
4,605,220 * 8/1986 Troxel .
4,787,630 * 11/1988 Watson et al. .
4,930,771 * 6/1990 Wilson ..... 482/146
5,244,444 * 9/1993 Wostry .
5,310,395 * 5/1994 Ko .
5,695,439 * 12/1997 Lin .
5,730,690 * 3/1998 Guidry .
5,810,751 * 9/1998 Meier et al. .

* cited by examiner

*Primary Examiner*—Jerome W. Donnelly
(74) *Attorney, Agent, or Firm*—Lambert & Associates, PLLC; Gary E. Lambert; Edward Timmer

(57) ABSTRACT

A rotatable and pivotal exercise system for performing weight resistant training exercises comprising a support platform having a base and an integrated support structure for adding structural strength, integrity and stability to said support platform, a pair of pivotally attached resistance arms and a pivotal support device pivotally engaged with a pivot support base attached to said support platform for pivotally supporting an exerciser. The pivotal support device and system may be adapted to accommodate an exerciser performing weight resistant training in either sitting, standing or bench supported positions. An exerciser positioned atop said pivotal support device and shifting weight relative to the vertical axis of said adjustable pivotal support device will cause said adjustable pivotal support device to pivot and rotate, thus requiring the exerciser to use their stabilizing muscles to balance and stabilize themselves as the exerciser moves the pivotally attached resistance arms throughout an exercise movement.

8 Claims, 9 Drawing Sheets

PORTABLE AND PIVOTAL STATIONARY EXERCISE SYSTEM

BACKGROUND OF THE INVENTION

The present invention pertains to exercise equipment. More particularly, the present invention relates to resistance-type exercise apparatus having pivotable and rotatable exerciser supports.

There are many forms of resistance-type exercise equipment on the market today. In general, resistance-type exercise equipment has historically been categorized as either "machine" or "free" weights. Exercising with free weights normally requires an individual exerciser to balance the weights as the weights are lifted and lowered throughout the range of the exercise movement. When exercising with free weights it is important that the exerciser stabilize their body prior to and while lifting the weighted resistance since the exerciser alone must balance the weights throughout the exercise movement. If the exerciser is unable to or fails to stabilize themselves while engaged in lifting free weights, the results can be both unsafe and injurious. The exerciser can easily hurt themselves straining to regain control of the weights or, failing to do so damage the weights and surrounding environment with the falling weights. Exercising with machine weights on the other hand usually does not require an exerciser to balance the weights being lifted. Machine weight training equipment normally restricts the range and direction of the weighted resistance movement to a single plane. Thus, the machine weights inherently provide stabilization of the weights for the individual exerciser, obviating the exerciser's need to balance and stabilize the weight. For this reason, resistance-type machine weights are generally viewed as being a safer form of resistance-type weight training than free weights.

While machine weights may be safer to use, machine weight training does not train or exercise the muscles used to stabilize the body. The muscles exercised and trained when using free weights are the same stabilization muscles are used in walking, bending and other sport exercises. Exercisers concentrating on machine resistance-type training may therefore find themselves ill-prepared for the stability requirements and demands found in actual real-world sports activities such as hockey, basketball, baseball, football, etc. The lack of stabilizing muscle training and strengthening gained by the machine weight exerciser can and often does result in the machine weight exerciser suffering injuries when engaging in other activities.

Thus, there currently exists a need for resistance-type weight training equipment that offers the exerciser the safety of machine weight training equipment and the stabilizing muscle training and strengthening provided by free weights. Those concerned with these and other problems recognize the need for an improved resistance-type exercise apparatus.

SUMMARY OF THE INVENTION

In accordance with the present invention it is therefore an objective to provide an exercise apparatus that supports an exerciser by means of a pivotable and rotatable support or supports requiring the exerciser to stabilize their body while engaged in resistance-type weight training.

It is a further object of the present invention to provide an exercise apparatus requiring the exerciser to employ the stabilizing muscles of the body while engaging in resistance-type weight training thereby strengthening and training the stabilizing muscles of the exerciser.

It is a further object of the present invention to provide an exercise apparatus offering the safety of use associated with traditional machine weights.

It is a further object of the present invention to provide an exercise apparatus that is easily adjustable and capable of accommodating individual exerciser's desired preferences.

It is a further object of the present invention to provide an exercise apparatus that is easy to use.

It is a further object of the present invention to provide an exercise apparatus that may be adapted for use with pre-existing exercise equipment.

The present invention results from the realization that a "machine" resistance-type training apparatus that requires an exerciser using said apparatus to stabilize their own body in relation to the weighted resistance necessarily requires the exerciser to use their stabilizing muscles and therefore is a better machine resistance-type exercise apparatus. Also, since the apparatus is a machine, the resistance-type equipment of the present invention will also have the benefit of the inherent safety of properly designed machine weights.

The present invention comprises machine weight equipment further including at least one pivotal and rotatable support structure for supporting the exerciser using the apparatus of the present invention. As in other resistance-type exercise machines known to those skilled in the art, the apparatus of the present invention provides stabilization of the weighted resistance. Therefore, the apparatus of the present invention offers the safety of use found in traditional machine weight devices. Furthermore, since the exerciser is supported by rotatable and pivotally mounted support structures in the present invention and the machine provides stabilization of the weighted resistance, the exerciser must stabilize their body in relation to the weighted resistance. This is contrary to traditional machine resistance-training devices and free weight devices. Former machine weight systems required no substantial stabilization of the weighted resistance throughout the exercise movement. Free weight training systems on the other hand required an exerciser on a stable, non-movable support structure (bench, floor, seat, etc.) to balance and stabilize the free weights. The present invention requires the exerciser using the present invention in resistance-type training to balance and stabilize their body as opposed to the weighted resistance while lifting the weight. Thus, the exerciser's stabilizing muscles are utilized, trained and strengthened in the course of exercising using the present invention. The exerciser receives the safety benefit of stabilized weights and the training benefit of training and strengthening the stabilizing muscles of the body.

The present invention features pivotal support structures for all of the resistance-type training exercise positions commonly encountered when exercising with resistance-type exercise equipment. The present invention is capable of facilitating exercises in which the exerciser sits, stands or is instead traditionally supported by a bench, either in a prone or upright sitting posture. Other exerciser positions may also be accommodated in a manner suitable and similar to those described in greater detail herein below.

In one embodiment of the invention facilitating exercises in which the exerciser stands, the exerciser actually stands, and is thereby supported, on a pivotal and rotatable base. Whereas the exerciser would traditionally stand directly on the floor or other stable platform at the appropriate height and standing position and have no need to balance themselves, the exerciser using the present invention must balance themselves. The amount of pitch and roll (sway) in the support system is either fixed or adjustable at the exerciser's discretion. It is contemplated that an adjustable support system would be the preferred embodiment so that exercisers could adjust the sway of the standing support system to fit their individual workout preferences.

Another embodiment of this invention facilitates resistance-type training in which the exerciser performs the exercise movement while sitting upright. The base of the sitting system on which the exerciser sits, and is thereby supported, is on a pivotal and rotatable base. The pivotal sitting support system is designed to isolate the exerciser from otherwise stabilizing support structures such as the floor. There are also included in this embodiment of the present invention pivotal and rotatable foot supports so that the exerciser is completely isolated from the floor or otherwise stable, non-pivotal support(s). Here too it is contemplated that an adjustable pivotal support system would be the preferred so that exercisers could adjust the sway of the seated support system to fit their individual workout preferences.

Yet another embodiment of this invention facilitates exercises in which the exerciser typically utilizes a bench structure such as during the bench press exercise movement. While the base of the bench itself may not be pivotally supported be due to the relatively large size of a bench capable of holding a person, the portion of the bench supporting the exerciser is mounted on a pivotal base. There are also included in this embodiment of the invention pivotal and rotatable foot supports so that the exerciser is completely isolated from the floor or otherwise stable, non-pivotal supports. Also, it is here too contemplated that an adjustable pivotal support system would be the preferred so that exercisers could adjust the sway of the seated support system to fit their individual preferences.

An exerciser using the present invention must use their stabilizing muscles to balance and stabilize their own body in relation to the weighted resistance while the apparatus provides limits to the range and direction of movement of the weighted resistance and a level of safety not found in "free" weights. Machine weights have the characteristic of limiting the possible range and direction of the weighted resistance and therefore are easier to control and safer to use. Since the range and direction of machine resistance-type equipment movements are limited, in the event that the exerciser loses control of the weights the exerciser is able to regain control of the equipment since the weighted resistance can only travel in known predetermined directions a predetermined range. "Free" weights require the exerciser alone to balance and control the weight. In the event that the exerciser training with free weights fails to control the free weights, even momentarily, the exerciser must regain control and balance the weights in order to prevent the weights from falling onto the exerciser. Since the range and direction of the movement of the free weights are not limited in range or motion, an exerciser unable to quickly stabilize the free weights may strain to regain control (i.e. stabilize) the free weights. The exerciser straining to control a weighted resistance is at an increased risk of becoming injured.

Further objectives and advantages of the present invention will become apparent from a careful reading of the detailed description provided hereinbelow, with appropriate reference to accompanying drawings. The drawings constitute part of this specification and include exemplary embodiments of the present invention and illustrate various objects and features thereof.

BRIEF DESCRIPTION OF THE DRAWINGS

The invention can be more fully understood from the following detailed description thereof in connection with accompanying drawings described as follows.

DETAILED DESCRIPTION OF THE PREFERRED EMBODIMENTS

Figure 1:
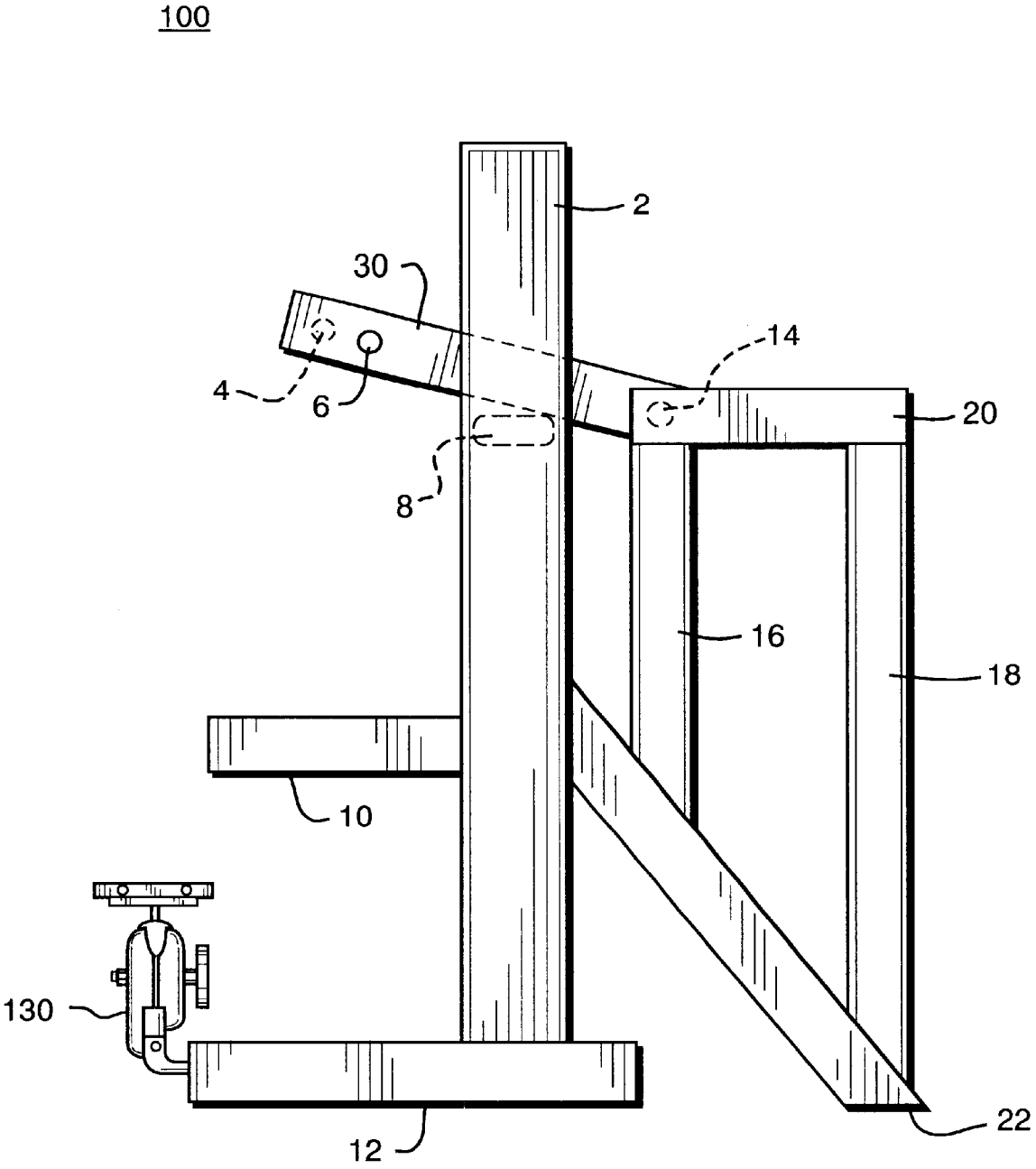
FIG. 1 is a plan view of the present invention configured to accommodate the sitting system apparatus.

Throughout the following detailed description, in the event that similar reference characters are called out, they refer to similar elements in all figures of the drawings.

In reference to FIG. 1 there is depicted generally at 100 the preferred embodiment of the invention presented herein configured to accommodate the sitting system apparatus of the present invention. The invention is also configured to accommodate the sitting system apparatus in FIG. 10 in a perspective view. The sitting system apparatus 300 is pivotal and rotatable about pivotal support 60. The sitting system apparatus 300, as shown in FIG. 3, is affixed to the seat platform 10 so that an exerciser using the present invention may perform weight resistance training exercises commonly executed with the exerciser in a seated position.

Figure 10:
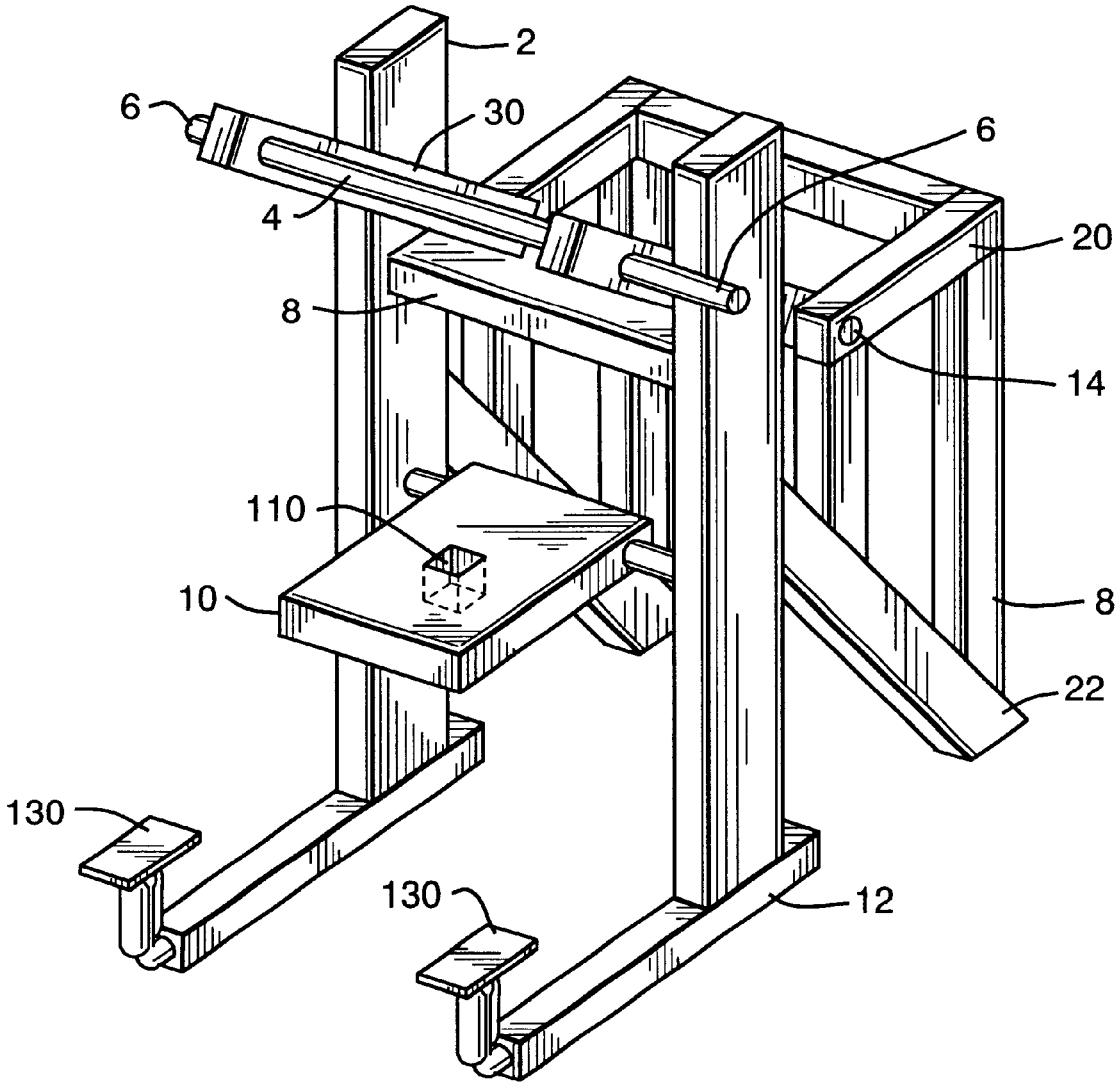
FIG. 10 is a perspective view of the present invention configured to accommodate the sitting system of the present invention.

Referring to FIGS. 1 and 10, the position of the seat platform 10 is typically stationary relative to the resistance arm 30. Typically, the seat platform 10 is placed in a position so that an exerciser sitting upon the pivotal and rotatable sitting system apparatus 300 is able to move the resistance arms 30 throughout the full range of motion of the muscle group(s) being exercised. In this way the exerciser is able to gain the most from each performance of the exercised movement.

The pivotal sitting system apparatus 300 upon which the exerciser sits pivots on the pivotal support 60 of the sitting system apparatus 300, thereby compelling the exerciser to use their stabilizing muscles to balance their body relative the weighted resistance of the exercise arms 30. To completely isolate the exerciser from any stable and non-pivoting support, foot support 130 is attached to the base 12 of the pivotal and rotatable exerciser system of the present invention. The foot support 130 may comprise a single unitary pivotal support capable of supporting both feet of the exerciser or instead two individual foot supports that individually pivot and support each foot of the exerciser. The important feature is that the foot support 130 isolates the exerciser's feet from the ground or other stable support surfaces. The foot support 130 is also typically adjustable in a manner similar to the sitting system apparatus 300 adjustable pivotal support 60.

Figure 3:
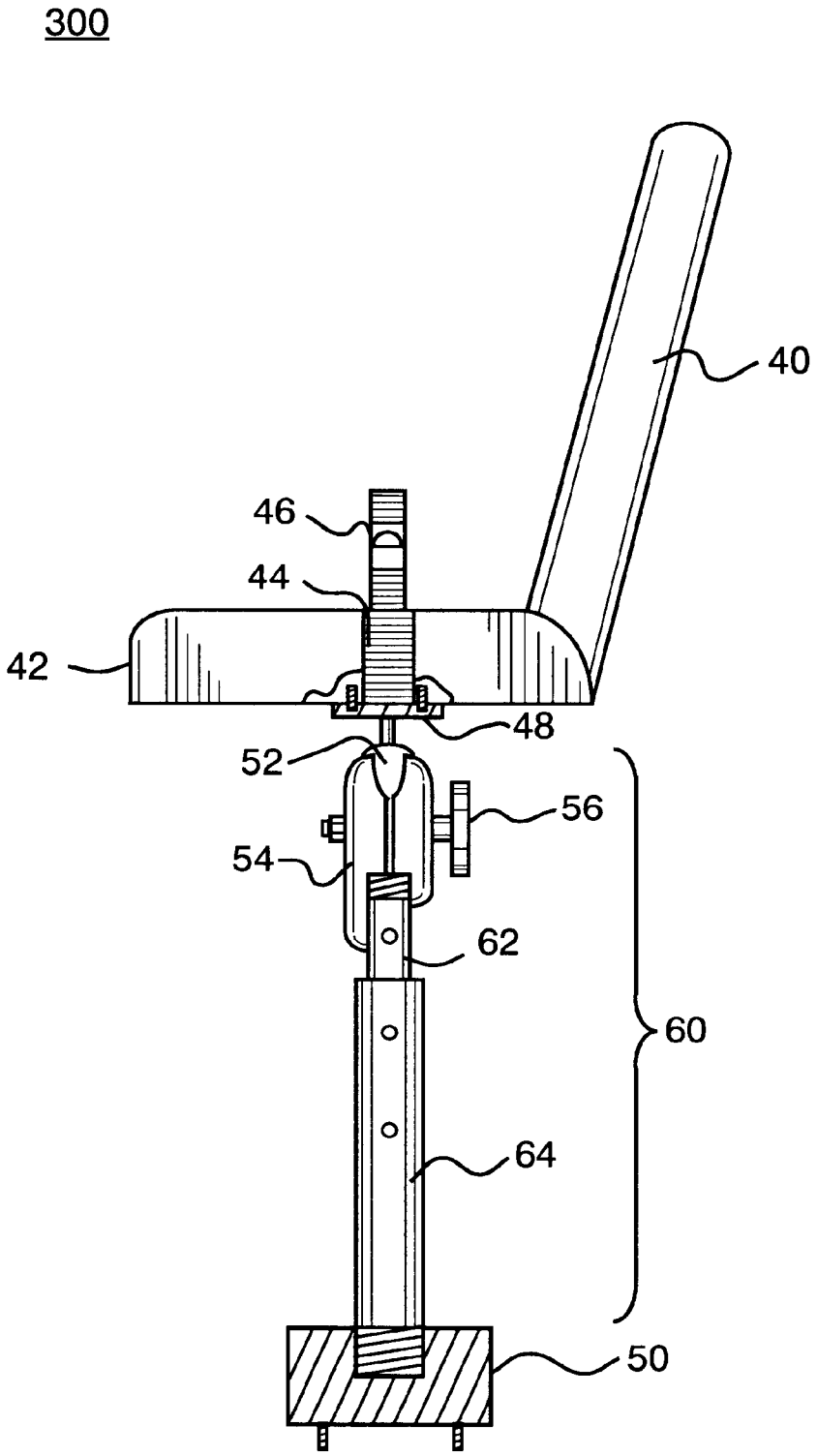
FIG. 3 is a plan view of a sitting system apparatus of the present invention that is used with the system of FIG. 1.
Figure 4:
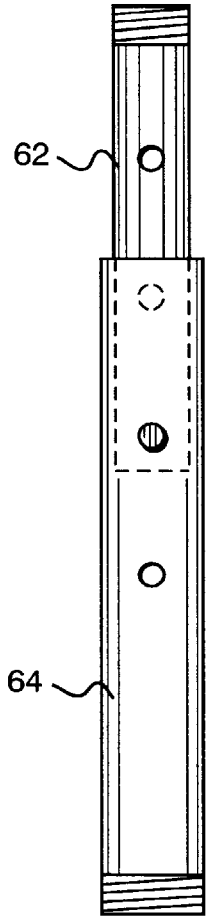
FIG. 4 is a detailed view of a adjustable height support of the present invention.

A pivotal support 60 depicted in FIG. 3 is typical in structure of the pivotal support 60 throughout the FIGS. included herein. The pivotal support comprises a ball joint 52 held in place by a double socket arm 54. The amount of force required to move the ball joint 52 is controlled by the tightening mechanism handle 56. Tightening of the handle 56 tightens the double socket arm 54 about the ball joint 52 thus increasing the amount of force required to move the ball joint 52 held by the double socket arm 54. In other words, the amount of pivot and rotation of the ball joint (i.e., sway) is controlled by the tightening handle 56.

Figure 5:
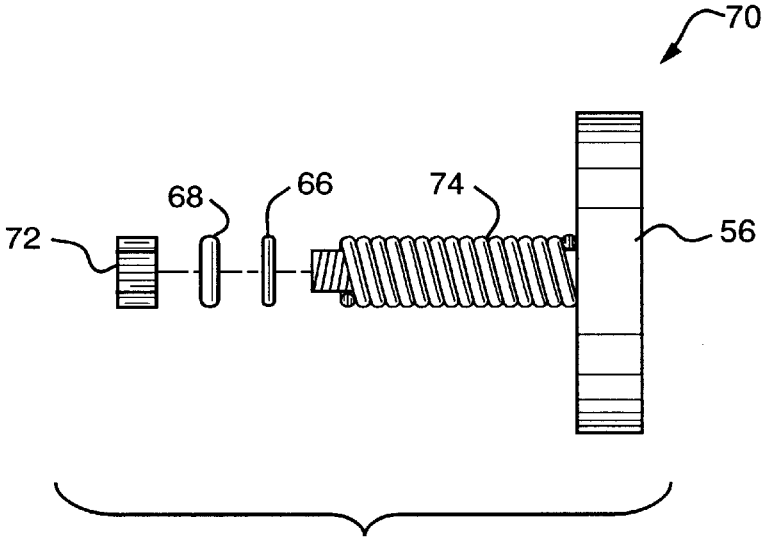
FIG. 5 is a detailed view of a tightening mechanism for the adjustable double socket arm of the present invention.

The tightening mechanism 70 of the pivotal support 60 is shown generally at 70 in FIG. 5. The tightening mechanism 70 typically comprises a spring-biased handle 56 having a threaded shaft. A spring 74 is fed onto the shaft of the handle 56 and the shaft of the handle 56 is then inserted through holes aligned in the two halves of the double socket arm 54. A metal washer 66 and a plastic washer 68 are then fed onto the threaded shaft of the handle 56. A nut 72 is then threaded on the end of the threaded handle 56 so that the tightening of the nut 72 on the shaft of handle 56 tightens the double socket arm as discussed above.

In addition to the adjustable sway of the pivotal support 60, the height of the pivotal support 60 is also adjustable. The height of the pivotal support 60 typically comprises a slide support pipe 62 disposed inside of a support pipe 64. The overall height of the pivotal support 60 is adjusted by varying the length of the slide pipe 62 extended above and out of the support pipe 64. The slide pipe 62 may be locked into its desired position relative the support pipe 64 by any number of means commonly understood by those skilled in the art of mechanical devices such as pins, nut and bolt, etc.

In reference to FIGS. 1 and 10, the pivotal and rotatable exerciser system 100 of the present invention is stabilized by a weight support structure attached to the center support 2 of the system 100. The support structure typically comprises vertical supports 16 and 18, brace 22 and top support 20. The weight support structure of the invention may take on forms not depicted herein, the present embodiment is not meant to limit the scope of the present invention but merely to illustrate one type of supportive structure contemplated. The critical feature of the weight support structure is that the weight support structure is able to stabilize the pivotal and rotatable exerciser system of the present invention so that the pivotal sitting system apparatus 300(or other pivotal apparatus) and foot support 130 supporting the exerciser are the only pivotal and rotatable exerciser supportive components of the system.

The stable support structure of the present invention helps provide the safety inherent in machine-type weight resistance exercise equipment by stabilizing the pivotal and rotatable exerciser system of the present invention.

Figure 9:
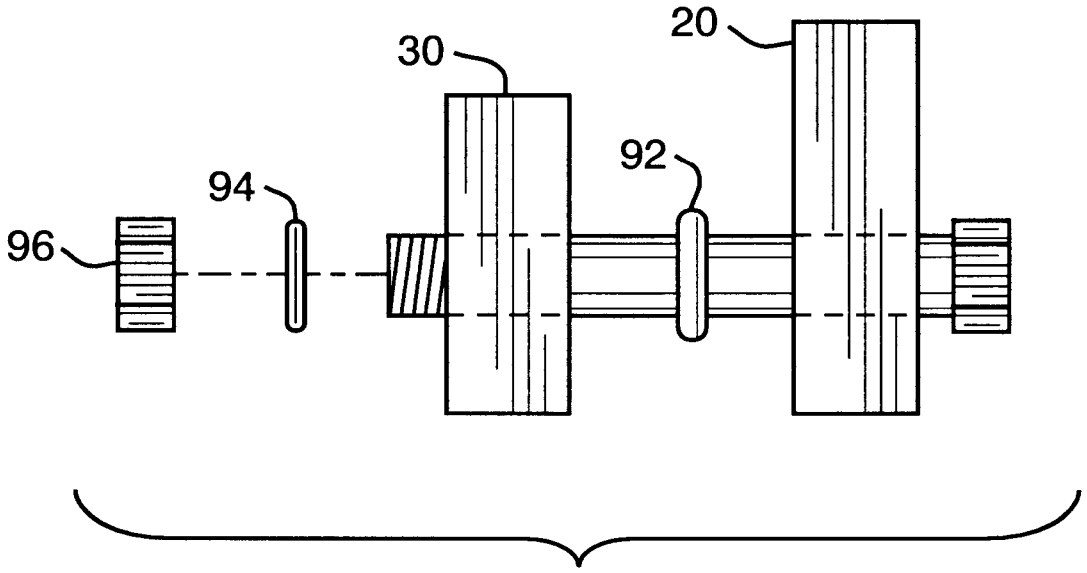
FIG. 9 is a detailed view of a resistance arm pivot joint of the present invention.

The resistance arms 30 pivot about pivot joint 14. A detailed depiction of pivot joint 14 is shown FIG. 9. The weight support structure 20 is pivotally linked to the resistance arms 30 by a bolt and nut 96. The resistance arms 30 and the support structure 20 are separated by a lubricated washer 92 to allow easy pivoting of the resistance arms 30.

In order to use the present invention embodied in FIGS. 1 and 10, the sitting system apparatus 300 is attached to the sitting platform 10. The base 50 of the sitting system apparatus 300 is positioned in a recess 110 located on the sitting platform 10, as depicted in FIG. 10. The exerciser sits upon the seat 42, resting their feet on foot support 130. The exerciser then proceeds to lift the resistance arms 30 to perform the desired exercise by grasping handle 4. The resistance arms 30 pivot about pivot joint 14. As the exerciser lifts the weighted resistance via the resistance arms 30 throughout the exercise movement, the exerciser will have to stabilize themselves since the exerciser is totally supported by the pivotal supports 60 of the sitting system apparatus 300 and the foot support 130. In the preferred embodiment of the invention, plate weights are added to the resistance arms of the invention by placing the plates on plate support post 6. The amount of weight to be lifted by the exerciser is conveniently added and removed by placing common plate weights on the plate support post 6. The resistance arms 30 are restricted from lowering below a certain level by a support shelf 8. The support shelf 8 adds a level of safety to the system since the resistance arms are only allowed to fall so far even if the exerciser loses control of the resistance arms. Though a support shelf has been depicted in the preferred embodiment of the present invention, other similar and dissimilar safety features found in machine-type resistance weight training equipment may be incorporated into the invention without departing from the scope of the present invention.

Additionally, the exerciser may be strapped into the sitting system apparatus 300 via a seat belt 46 for an added level of safety. The seat belt 46 may be latched about the waist of the exerciser by engaging the belt 46 and the latch plate 44. The chair back 40 is typically adjustable to accommodate the different sizes and preferences of individual exercisers. The chair itself is attached to the pivotal support 60 by a plate 48 having one side attached to the bottom of the chair seat 42 and the other side attached to the ball joint 52 of the pivotal support 60.

Figure 2:
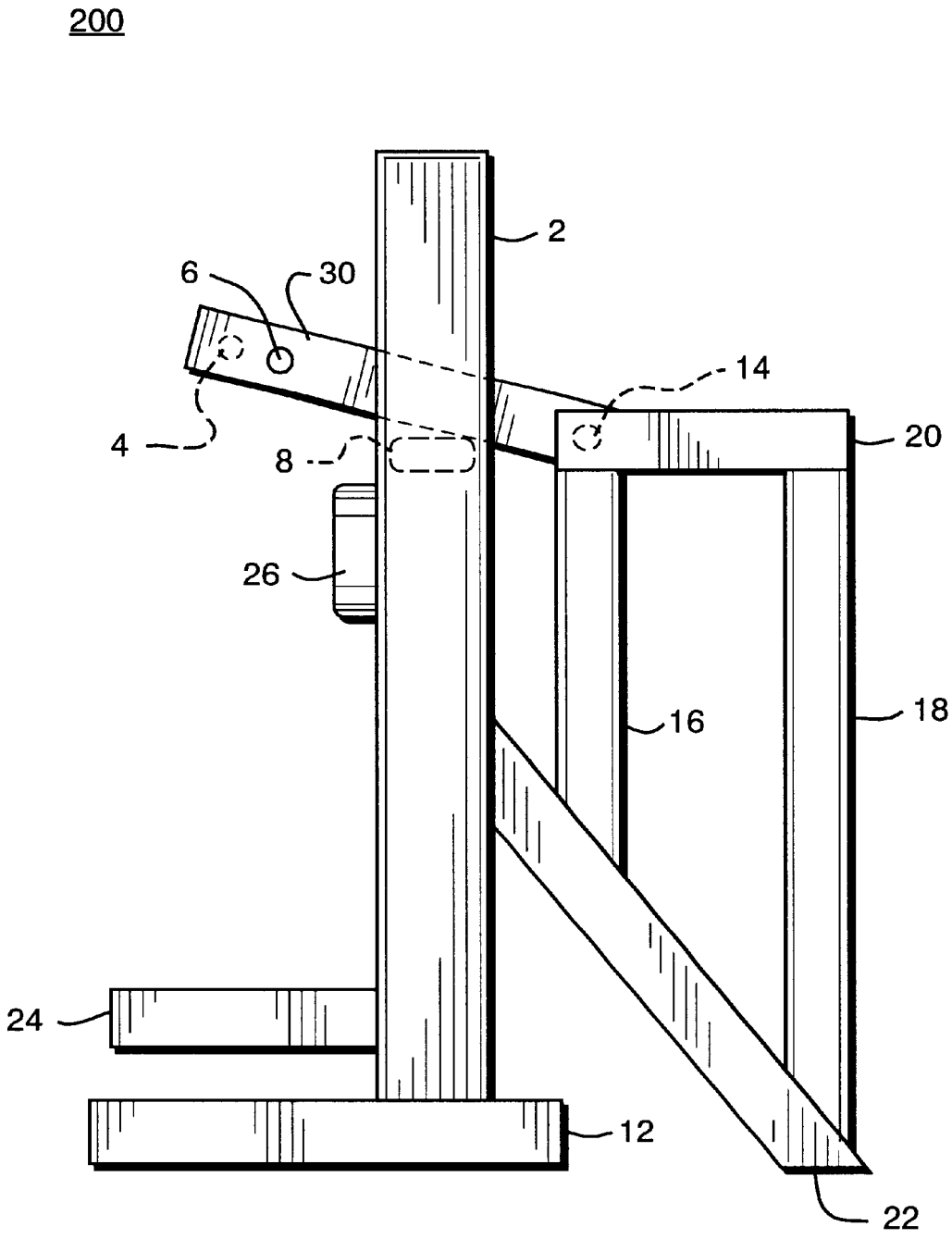
FIG. 2 is a plan view of the present invention configured to accommodate a standing platform.
Figure 8:
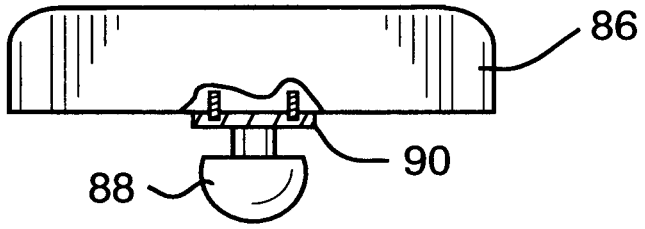
FIG. 8 is an exerciser standing support platform.

FIG. 2 depicts the present invention configured to accommodate a pivotal standing platform generally at 200. The pivotal standing platform depicted in FIG. 8 is attached to a pivot support base 24 via a pivotal support 60. The pivot support base 24 is attached to a pivotal support similar to the pivotal support 60 discussed above in relation to the sitting apparatus 300 and depicted in FIG. 3. The pivot support platform is attached to the center post 2 of the system 200. The ball joint 88 is received and held by the double socket arm 54. The pivotal support 60 receiving the ball joint 88 that is attached to the bottom of the standing platform base 86 is further attached to the pivot support base 24 in a recess (not shown) in the top of the pivot support base 24 in a manner similar to the sitting apparatus' 300 reception in recess 110 of FIG. 10. As with the sitting apparatus 300 discussed earlier, the pivotal support 60 supporting the standing platform 24 of the present invention configured for pivotally supporting a standing exerciser is typically pivotally, rotationally and height adjustable. The pivot support 24 is typically adjustable relative to the resistance arms 30. The adjustable pivot base 24 allows exercisers of different sizes and preferences to use and equally enjoy the benefits of the present invention. An exerciser performing exercise movements requiring the exerciser to stand, stands on the pivotal standing platform attached the pivot support base is 24. Thus, standing the pivotal standing platform the exerciser is isolated from the floor or any other stable support.

Figure 6:
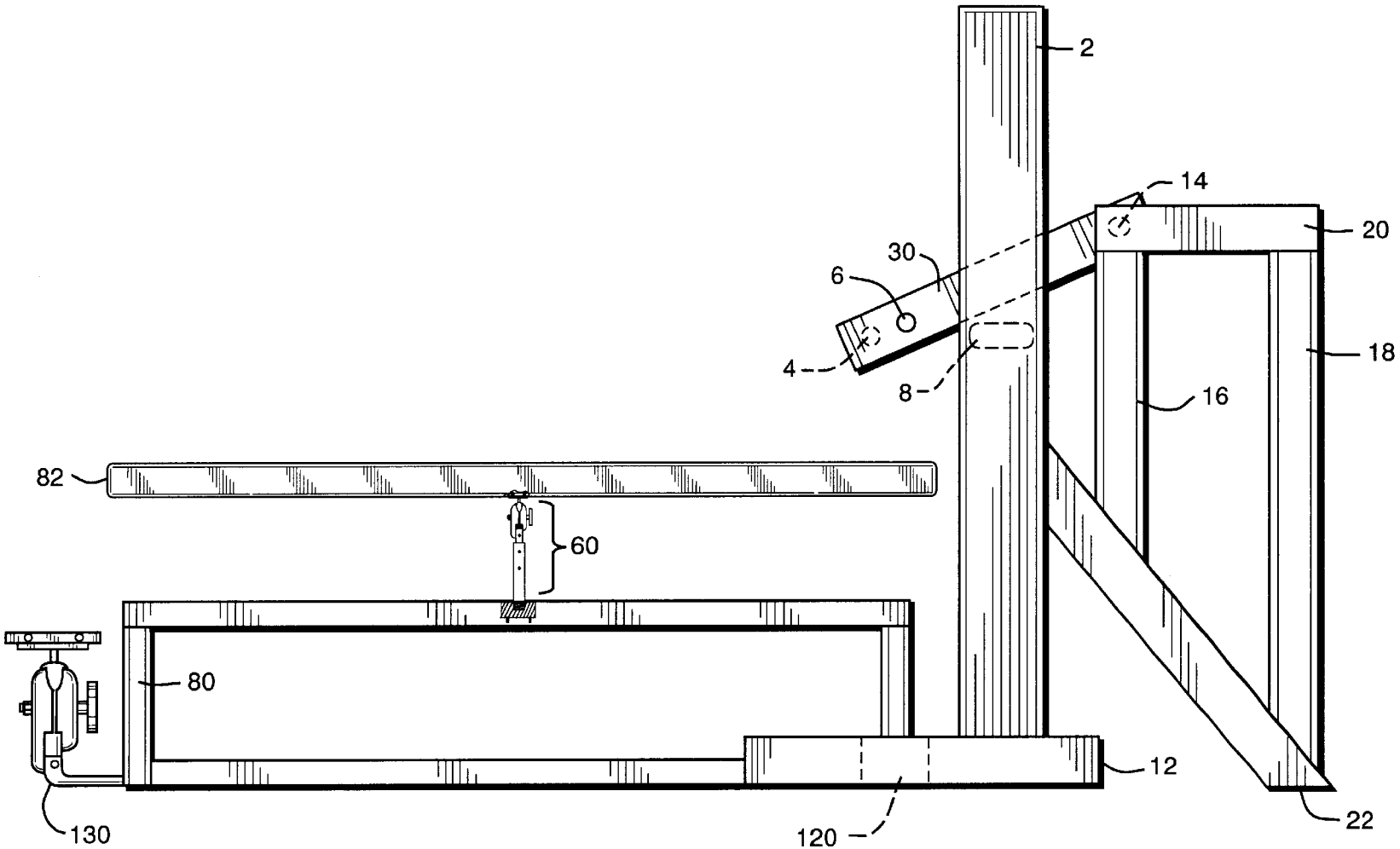
FIG. 6 is a plan view of the present invention configured to accommodate an exerciser support bench apparatus, including said exerciser support bench apparatus.
Figure 7:
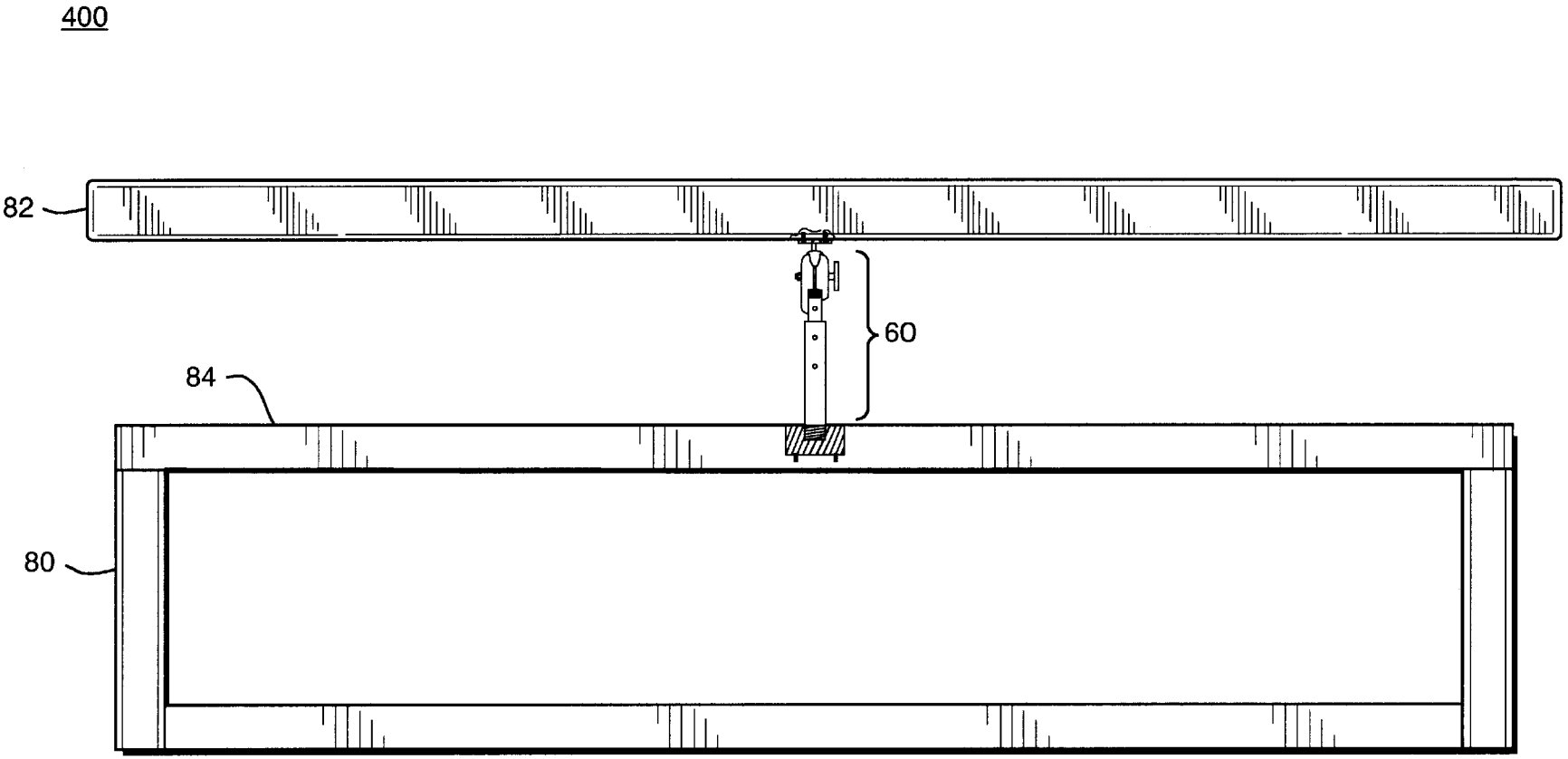
FIG. 7 is a plan view of an exerciser support bench of the present invention.
Figure 11:
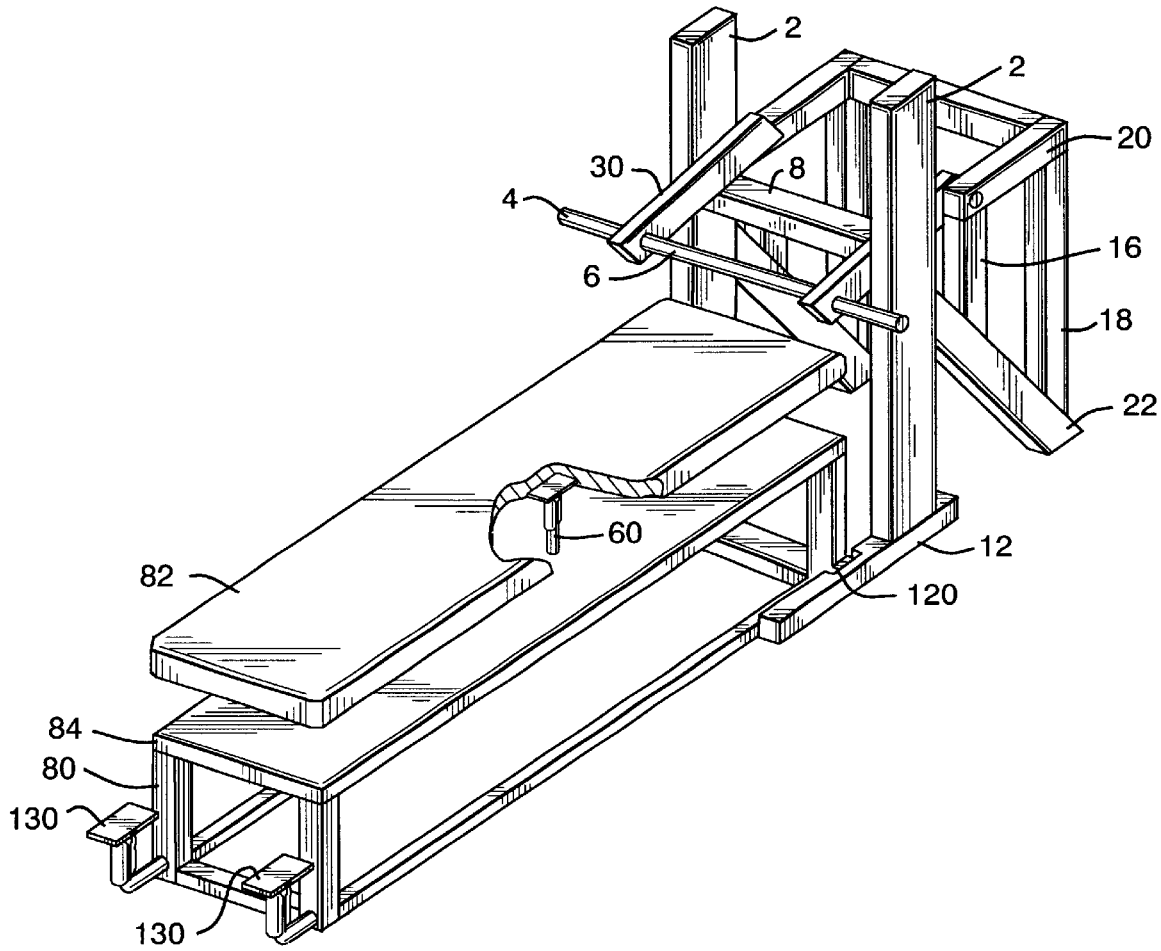
FIG. 11 is a perspective view of the present invention configured to accommodate an exerciser support bench apparatus, including said exerciser support bench apparatus.

An exerciser may also use the present invention configured to accommodate exercises in which the exerciser uses a bench as depicted in FIGS. 6, 7 and 10. The FIG. 6 is a plan view of the present invention showing the weight support structure and a bench support apparatus 80 including a pivotally supported bench 82. The FIG. 7 shows a plan view of the bench support structure 80 and bench 82 only and the FIG. 11 shows a perspective view of the present invention configured to accommodate exercises in which the exerciser uses a pivotally supported bench 82. In FIGS. 6 and 11, a bench support structure 80 is attached to a support structure base 12 at a position 120. The position 120 may encompass a cut-out that receives the bench support structure 80 as depicted in FIG. 11 or a weld, clamps or other means for holding the bench support structure in fixed proximity to the weight support structure. The important factor in the attachment of bench support structure 80 to the support structure base 12 is that the bench support structure 80 is held in a stationary position relative to the rest of the invention. The bench 82 is pivotally supported by the pivotal support 60. The base of the pivotal support 60 attaches the bench support structure 80 and the ball joint end of the pivotal support 60 is attached to the bench 82. As depicted in the FIG. 6 and FIG. 11, there is one centrally located pivotal support 60 supporting the bench 82. Although two or more supports could be used to support the bench 82, the use of one centrally located pivotal support 60 enables the greatest possible amount of pivoting of the bench 82.

Also included in the bench configuration of the present invention is a foot support 130. In the preferred embodiment as depicted in FIG. 11, the foot support 130 is separated into two individual foot supports. The foot supports 130 here are similar to the foot supports used in the sitting position configuration of the present invention. The foot supports 130 operate to completely isolate the exerciser from the floor or other stable support surface. Additionally, a safety belt(not shown) may be attached to the bench 82 for securely holding the exerciser to the bench 82. Preferably, the safety belt attached to the bench 82 is adjustable in order to accommodate exercisers of varying sizes and preferences.

An exerciser lifting resistance arms 30 does so by grasping and holding handle 4. The handle 4 of the invention has been depicted in FIGS. 10 and 11 as a continuous structure linking one resistance arms 30 to the other. There is no requirement that the resistance arms 30 be linked. Instead it is quite feasible, and even desirable in certain circumstances, that each resistance arm 30 is allowed to pivot individually of the other resistance arm 30. In these circumstances, the handle 4 does not extend from one side of the system to the other side of the invention.

While the invention has been described and illustrated with reference to a specific embodiments thereof, it is understood that other embodiments may be resorted to without departing from the invention. Therefore the form of the invention set out above should be considered illustrative and not as limiting the scope of the following claims.

What I claim is:

1. A rotatable and pivotal exercise system for performing weight resistant training exercises comprising:

a stationary support platform having a base and an integrated support structure for adding structural strength, integrity and stability to said support platform, a pair of resistance arms pivotally attached to said support platform;

a pivot support base adjustably attached to said support platform relative to the position of said resistance arms and having an upper surface and a lower surface;

a sitting system apparatus having a chair, the chair having a top and bottom surface wherein attached to the bottom surface of the chair is a pivoting means for pivotally engaging with a pivotal support further having a base wherein the base of said pivotal support engaged with said sitting system apparatus is attached to the upper surface of said pivot support base whereby an exerciser sitting atop the chair of said sitting system apparatus is pivotally supported by said sitting system apparatus; and a pivotal foot support pivotally attached to the base of the support platform of the exercise system thereby completely isolating an exerciser seated atop the pivotally supported sitting system apparatus from any non-pivoting support surface when the exerciser places his or her feet upon the foot support.

2. A rotatable and pivotal exercise system of claim 1 wherein:

the pivotal support of the sitting system apparatus is height adjustable.

3. A rotatable and pivotal exercise system of claim 1 wherein:

the pivotal foot support comprises two individual pivotal foot supports for separately and individually supporting the feet of an exerciser.

4. The pivotal foot support of claim 3 wherein:

the pivotal foot supports are height adjustable.

5. A rotatable and pivotal exercise system for performing weight resistant training exercises comprising:

a stationary support platform having a base and an integrated support structure for adding structural strength, integrity and stability to said support platform;

a pair of resistance arms pivotally attached to said support platform;

a pivot support base adjustably attached to said support platform relative to the position of said resistance arms and having an upper surface and a lower surface;

a bench support apparatus having a pivotally supported bench having a upper and bottom surface and a bench support structure having a top and bottom surface and stationarily attached to the support platform of the exercise system wherein the bottom of said pivotally supported bench is attached to a pivotal supports, the pivotal support further having a base attached to the upper surface of said bench support structure whereby an exerciser positioned atop said pivotally supported bench is pivotally supported by said bench support apparatus; and a pivotal foot support pivotally attached to the base of the support platform of the exercise system thereby completely isolating an exerciser seated atop the pivotally supported sitting system apparatus from any non-pivoting support surface when the exerciser places his or her feet upon the foot support.

6. A rotatable and pivotal exercise system of claim 5 wherein:

the pivotal support of the bench support apparatus is height adjustable.

7. A rotatable and pivotal exercise system of claim 5 wherein:

the pivotal foot support comprises two individual pivotal foot supports for separately and individually supporting the feet of an exerciser.

8. The pivotal foot support of claim 7 wherein;

the pivotal foot supports are height adjustable.

* * * * *